US009139386B2

(12) United States Patent
Shimosaka et al.

(10) Patent No.: US 9,139,386 B2
(45) Date of Patent: Sep. 22, 2015

(54) DOCUMENT FEEDER

(71) Applicant: PFU Limited, Kahoku-shi, Ishikawa (JP)

(72) Inventors: Kiichiro Shimosaka, Ishikawa (JP); Ryoichi Yasukawa, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 14/106,333

(22) Filed: Dec. 13, 2013

(65) Prior Publication Data

US 2014/0175732 A1 Jun. 26, 2014

(30) Foreign Application Priority Data

Dec. 20, 2012 (JP) ..... 2012-278370

(51) Int. Cl.

*B65H 3/66* (2006.01)
*B65H 3/06* (2006.01)
*B65H 5/06* (2006.01)

(52) U.S. Cl.

CPC ..... *B65H 3/063* (2013.01); *B65H 3/0653* (2013.01); *B65H 3/66* (2013.01); *B65H 5/062* (2013.01); *B65H 2402/46* (2013.01); *B65H 2404/55* (2013.01); *B65H 2404/5511* (2013.01); *B65H 2404/5512* (2013.01); *B65H 2404/611* (2013.01); *B65H 2404/74* (2013.01); *B65H 2511/13* (2013.01); *B65H 2515/50* (2013.01); *B65H 2601/125* (2013.01); *B65H 2601/522* (2013.01); *B65H 2601/524* (2013.01); *B65H 2801/39* (2013.01)

(58) Field of Classification Search

CPC ..... B65H 3/5223; B65H 3/56; B65H 3/5261; B65H 3/5246; B65H 3/5238; B65H 5/38; B65H 5/062; B65H 3/063; B65H 3/66; B65H 5/36; B65H 2404/5211; B65H 2404/5214; B65H 2404/55; B65H 2404/5511; B65H 2404/5512; B65H 2404/5513; B65H 2404/552; B65H 2404/60; B65H 2404/611; B65H 2404/74; B65H 2404/741; B65H 2404/7412; B65H 2511/13; B65H 2515/50; B65H 2515/81; B65H 2515/82; B65H 2601/125; B65H 2601/524; B65H 2601/5242

USPC ..... 271/121, 122, 124, 264, 131, 137; 399/365, 367

See application file for complete search history.

(56) References Cited

U.S. PATENT DOCUMENTS

| | | | | | |
|---|---|---|---|---|---|
| 4,556,209 | A | * | 12/1985 | Tsubo | 271/10.16 |
| 5,094,440 | A | * | 3/1992 | Matsuo et al. | 271/121 |
| 5,485,991 | A | * | 1/1996 | Hirano et al. | 271/121 |
| 5,527,029 | A | * | 6/1996 | Bortolotti et al. | 271/124 |
| 5,562,402 | A | * | 10/1996 | Muto | 414/797.7 |
| 6,086,062 | A | * | 7/2000 | Nakamura et al. | 271/121 |

(Continued)

FOREIGN PATENT DOCUMENTS

| | | | |
|---|---|---|---|
| JP | 04-208764 | A | 7/1992 |
| JP | 10-271271 | A | 10/1998 |

(Continued)

*Primary Examiner* — Ernesto Suarez

(74) *Attorney, Agent, or Firm* — McDermott Will & Emery LLP

(57) ABSTRACT

A document feeder includes a feed roller provided in a feed path for a document, a conveying roller provided on a downstream side of the feed roller in the feed path, and a protruding portion provided between the feed roller and the conveying roller in the feed path and protruding from a lower side of the feed path.

5 Claims, 8 Drawing Sheets

(56) References Cited

U.S. PATENT DOCUMENTS

| | | | | |
|---|---|---|---|---|
| 6,663,098 | B2 * | 12/2003 | Teo et al. | 271/121 |
| 8,322,715 | B2 * | 12/2012 | Mandel et al. | 271/264 |
| 8,496,241 | B2 * | 7/2013 | Osakabe et al. | 271/121 |
| 8,577,276 | B2 * | 11/2013 | Kim et al. | 399/388 |
| 8,752,832 | B2 * | 6/2014 | Mitamura | 271/264 |
| 2006/0180989 | A1 * | 8/2006 | Seike et al. | 271/121 |

FOREIGN PATENT DOCUMENTS

| | | | |
|---|---|---|---|
| JP | 11-222336 | A | 8/1999 |
| JP | 2001-350299 | A | 12/2001 |

* cited by examiner

DOCUMENT FEEDER

CROSS-REFERENCE TO RELATED APPLICATION

This application is based upon and claims the benefit of priority from Japanese Patent Application No. 2012-278370, filed on Dec. 20, 2012, the entire contents of which are incorporated herein by reference.

BACKGROUND OF THE INVENTION

1. Field of the Invention

The present invention relates to a document feeder.

2. Description of the Related Art

Some image-reading apparatuses for documents include a feeder for performing an intended processing while conveying a document. In such image-reading apparatuses including a feeder, a document placed on a tray or the like can be sequentially conveyed by rollers and the conveyed documents can be sequentially read. In such a feeder included in image-reading apparatuses, vibration occurring during conveyance of the document, which may cause poor images, needs to be avoided. For that purpose, some conventional feeders include a member for providing a document being conveyed with a biasing force for the purpose of reducing the vibration of the document. To provide a biasing force on a document for reducing the vibration of the document, some methods have been developed such as adding a biasing force by a movable member, and adding a biasing force by a guiding protrusion (refer to Japanese Patent Application Laid-open No. 11-222336, Japanese Patent Application Laid-open No. 10-271271, Japanese Patent Application Laid-open No. 04-208764, and Japanese Patent Application Laid-open No. 2001-350299, for example).

When the vibration of the document is reduced by adding a biasing force on a document, the conveyance of the document is likely to be obstructed.

SUMMARY OF THE INVENTION

It is an object of the present invention to at least partially solve the problems in the conventional technology.

According to an aspect of the present invention, a document feeder includes a feed roller provided in a feed path for a document, a conveying roller provided on a downstream side of the feed roller in the feed path, and a protruding portion provided between the feed roller and the conveying roller in the feed path and protruding from a lower side of the feed path.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A document feeder according to an embodiment of the present invention will now be described in detail with reference to the accompanying drawings. The present invention, however, is not limited to the following embodiment. The components of the following embodiment include components that can be easily replaced by persons skilled in the art or that are substantially the same as the components known by those in the art.

Embodiment

Figure 1:
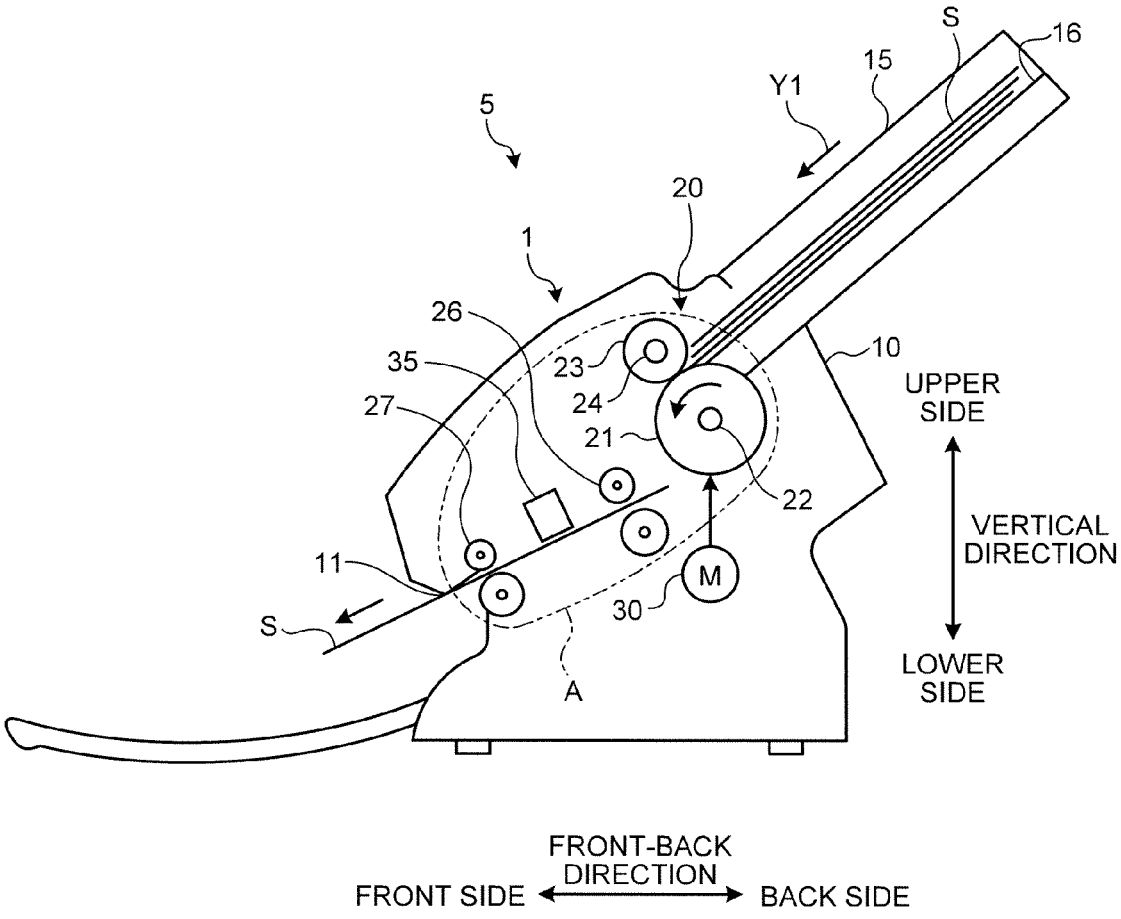
FIG. 1 is a schematic view of a document feeder according to an embodiment of the present invention.

FIG. 1 is a schematic view of a document feeder according to an embodiment of the present invention. A feeder 1 illustrated in FIG. 1 is a device that conveys sheets S that are a plurality of stacked objects to be conveyed while separating them one by one. The feeder 1 is applied to an automatic sheet feeding mechanism included in an image-reading apparatus such as a scanner and a facsimile machine. An image-reading apparatus 5 that includes the feeder 1 is described in the embodiment of the present invention, as an example of the image-reading apparatus.

The image-reading apparatus 5 includes a tray 15 and a separation mechanism 20. The tray 15 is provided as a document stacking table that accommodates a plurality of sheets S serving as documents used for image-reading in a stacked manner. The tray 15 includes a placement surface 16 that faces upward. The placement surface 16 of the tray 15 is tilted so that the rear end thereof is positioned higher. A plurality of sheets S can be stacked on the placement surface 16.

The separation mechanism 20 is provided in a housing 10 of the image-reading apparatus 5 and on the downstream side in the conveying direction Y1 of the sheet S with respect to the placement surface 16. The separation mechanism 20 separates the sheets S one by one from a plurality of sheets S stacked on the placement surface 16 and conveys them. Specifically, the separation mechanism 20 includes a pick-up roller 21 that serves as a feed roller feeding a sheet S and a brake roller 23 that stops sheets S other than the sheet S fed by the pick-up roller 21.

Figure 2:
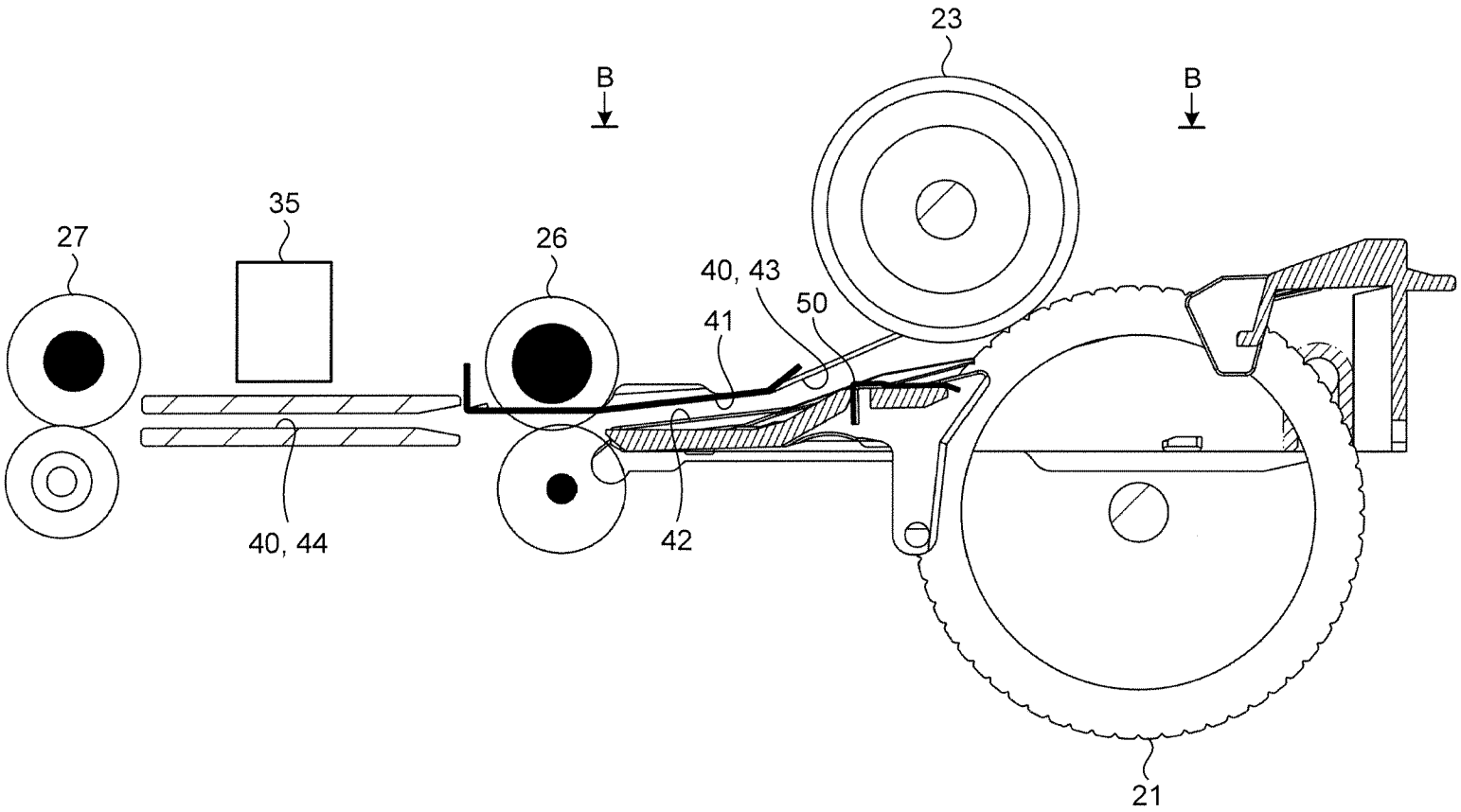
FIG. 2 is a detailed view of the section A illustrated in FIG. 1.

The pick-up roller 21 and the brake roller 23 are provided facing each other on both sides in the thickness direction of the sheet S in a feed path 40 (refer to FIG. 2). For example, the pick-up roller 21 is provided on the lower side of the extended plane of the placement surface 16, and the brake roller 23 is provided at a position across the pick-up roller 21 on the upper side of the extended plane of the placement surface 16. The pick-up roller 21 and the brake roller 23 are rotatable around rotating shafts 22 and 24 respectively that are extended in the width direction of the placement surface 16.

A driving unit 30 that includes a power source such as an electric motor and a driving force transmission mechanism such as a gear is provided in the housing 10. The driving unit 30 transmits the driving force that enables the pick-up roller 21 and the brake roller 23 to rotate. Specifically, the pick-up roller 21 rotates around the rotating shaft 22 so that its outer circumference surface on the side of the feed path 40 of the sheet S rotates in the conveying direction Y1. By contrast, the brake roller 23 rotates around the rotating shaft 24 so that its outer circumference surface on the side of the feed path 40 of the sheet S rotates in the reverse direction of the conveying direction Y1.

A conveying roller 26 is provided on the downstream side of the separation mechanism 20 in the conveying direction Y1 of the sheet S in the housing 10. An ejecting roller 27 is provided in the vicinity of an ejecting port 11 for the sheet S on the downstream side in the conveying direction Y1 of the conveying roller 26.

An image reading unit 35 is provided between the conveying roller 26 and the ejecting roller 27 in the conveying direction Y1 of the sheet S in the housing 10. The image reading unit 35 reads images on the conveyed sheet S. This enables the image-reading apparatus 5 to read images on the sheet S conveyed through the housing 10.

FIG. 2 is a detailed view of the section A illustrated in FIG. 1. The feed path 40 includes a lead-in portion 43 and a reading unit 44. The lead-in portion 43 leads the sheet S placed on the tray 15 into the feeder. The reading unit 44 is located on the downstream side of the lead-in portion 43 in the conveying direction Y1, includes the image reading unit 35, and reads images on the led-in sheet S. The feed path 40 includes an upper surface of the feed path 41 and a lower surface of the feed path 42. The upper surface of the feed path 41 is a wall surface located on the upper side of the sheet S conveyed by the feeder 1. The lower surface of the feed path 42 is a wall surface located on the lower side of the sheet S. The pick-up roller 21 and the brake roller 23 are provided on the upstream side of the lead-in portion 43 in the feed path 40. The conveying roller 26 is provided between the lead-in portion 43 and the reading unit 44 in the feed path 40. The ejecting roller 27 is provided on the downstream side of the reading unit 44 in the feed path 40.

The feed path 40 bends in the vertical direction, that is, the thickness direction of the sheet S between the lead-in portion 43 and the reading unit 44. The feed path 40 also bends in the thickness direction of the sheet S in the lead-in portion 43. Specifically, the lead-in portion 43 bends so that the position of the end portion of the pick-up roller 21 in the vertical direction is higher than the position of the end portion of the conveying roller 26 in the vertical direction.

A protruding portion 50 is formed on the lower surface of the feed path 42 in the lead-in portion 43 in the feed path 40. The protruding portion 50 protrudes from the lower surface of the feed path 42 into the feed path 40, that is, toward the upper surface of the feed path 41. In other words, the protruding portion 50 is provided between the pick-up roller 21 and the conveying roller 26 in the feed path 40 and formed so as to protrude from the lower surface of the feed path 40. The protruding portion 50 protrudes from the lower surface of the feed path 42 with the height slightly smaller than the height of the designed path for the sheet S when the sheet S is conveyed through the feed path 40, that is, the height of the feed path for the sheet S conveyed in an ideal manner.

Figure 3:
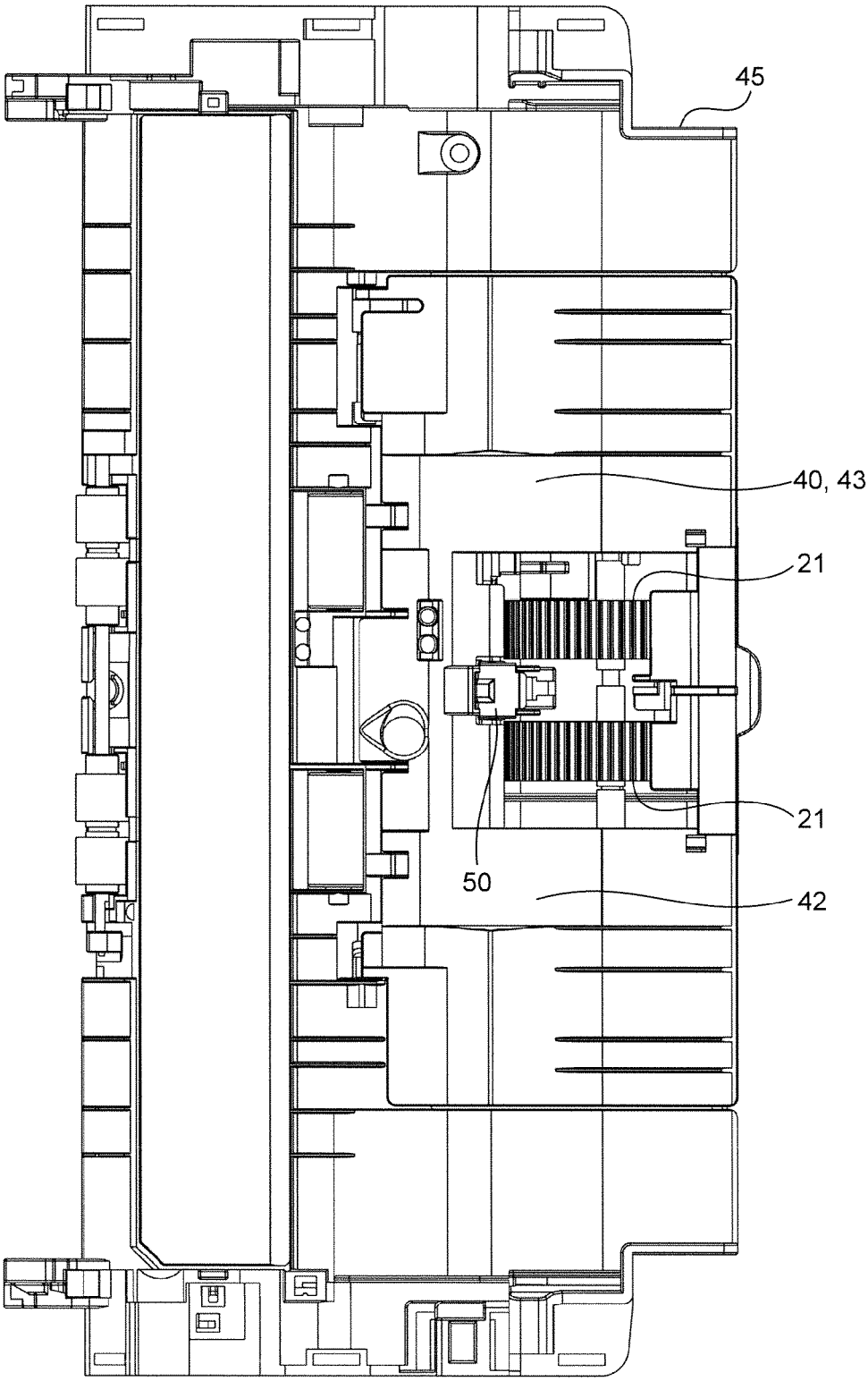
FIG. 3 is a fragmentary view taken in the direction of the arrows B-B in FIG. 2.

FIG. 3 is a fragmentary view taken in the direction of the arrows B-B in FIG. 2. The protruding portion 50 formed on the lower surface of the feed path 42 in the feed path 40 is provided in the vicinity of the pick-up roller 21 and nearly at the center of the feed path 40, in the lateral direction of the sheet S, which is perpendicular to both the conveying direction and the thickness direction of the sheet S. Specifically, the two pick-up rollers 21 having respective nearly equal radii and respective nearly equal widths are provided side by side separated from each other. The protruding portion 50 is provided on a position in the vicinity of the end portion on the downstream side of the pick-up roller 21 in the conveying direction in the feed path 40. The protruding portion 50 is provided so that its lateral direction is located between the two pick-up rollers 21. The protruding portion 50, arranged as described above, is provided on a member of the lower surface of the path 45 that includes the lower surface of the feed path of the lead-in portion 43 in the feed path 40. The member of the lower surface of the path 45 is made of a synthetic resin material, for example, and has the elasticity accompanied with the strength of the synthetic resin material.

Figure 4:
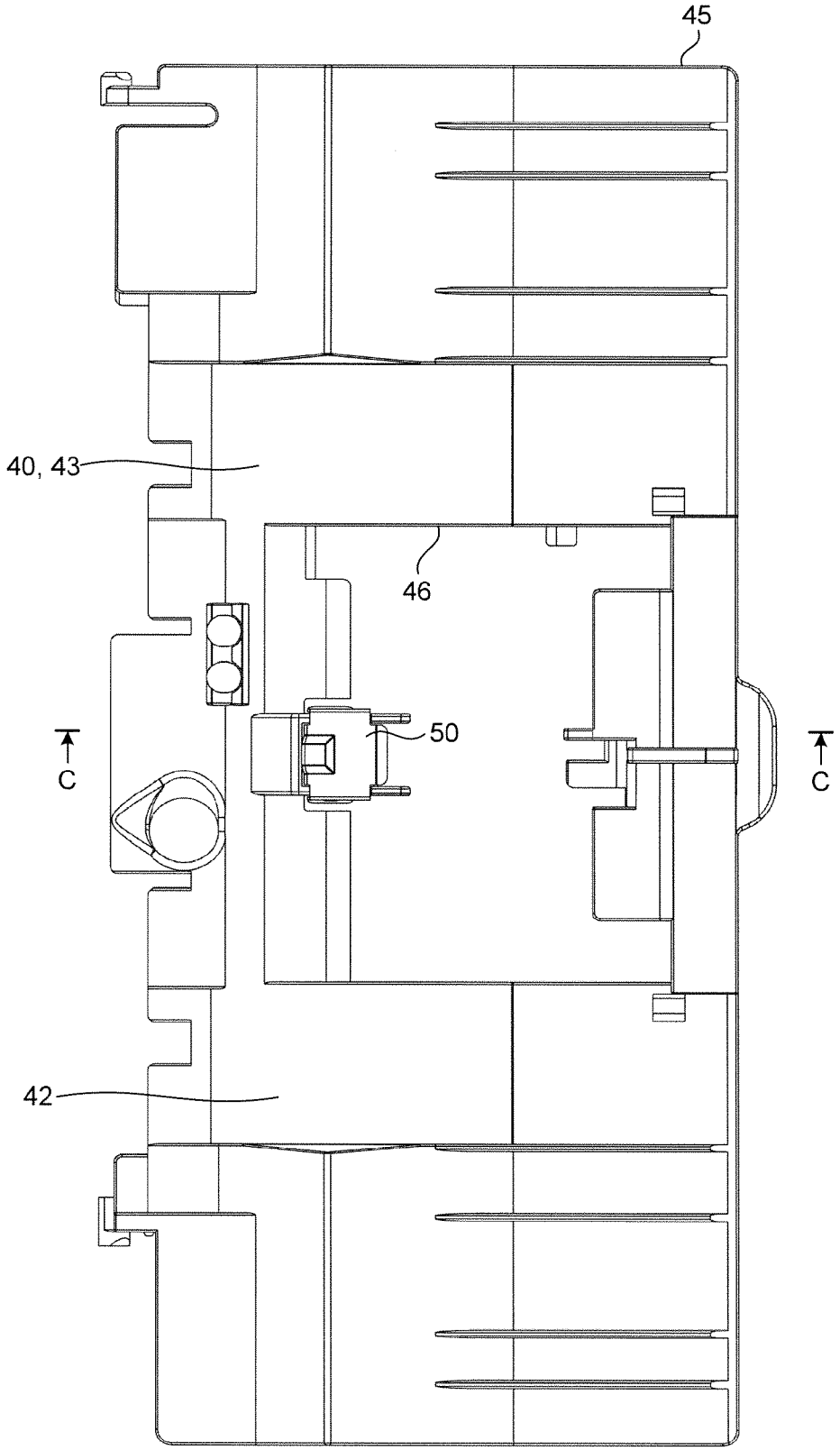
FIG. 4 is a plan view of a member of the lower surface of a path illustrated in FIG. 3.
Figure 5:
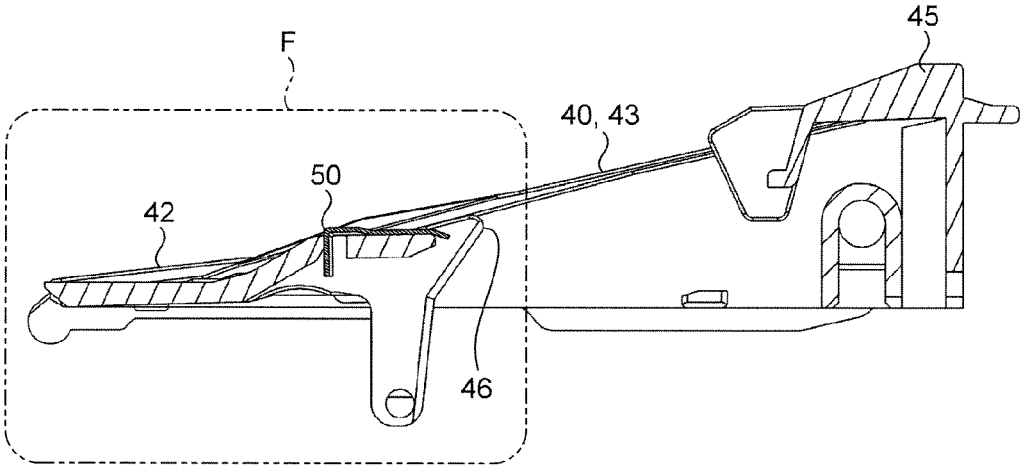
FIG. 5 is a cross-sectional view taken along the line C-C in FIG. 4.
Figure 6:
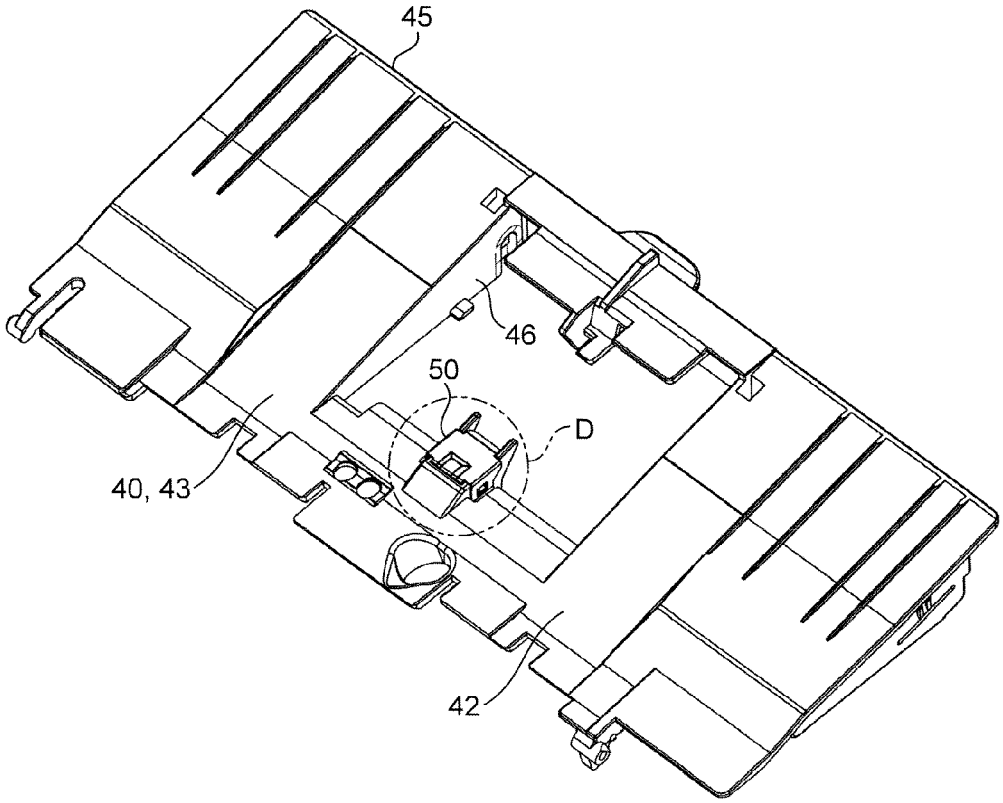
FIG. 6 is a perspective view of the member of the lower surface of the path illustrated in FIG. 4.

FIG. 4 is a plan view of the member of the lower surface of the path illustrated in FIG. 3. FIG. 5 is a cross-sectional view taken along the line C-C in FIG. 4. FIG. 6 is a perspective view of the member of the lower surface of the path illustrated in FIG. 4. A pick-up roller arrangement portion 46 that exposes the pick-up roller 21 to the feed path 40 is formed in the member of the lower surface of the path 45. Specifically, the pick-up roller 21 is provided below the member of the lower surface of the path 45. The pick-up roller arrangement portion 46 is formed as an opening for locating an upper end portion of the pick-up roller 21 in the feed path 40 and locating the two pick-up rollers 21 together in the feed path 40. The upper surface of the member of the lower surface of the path 45 including the surrounding surface of the pick-up roller arrangement portion 46 is formed as the lower surface of the feed path 42.

The protruding portion 50 is formed in the vicinity of the end portion on the downstream side of the pick-up roller arrangement portion 46 in the conveying direction in the feed path 40, and at the center in the lateral direction of the pick-up roller arrangement portion 46. The protruding portion 50 has a predetermined length in the conveying direction and a predetermined width in the lateral direction. The protruding portion 50 protrudes upward higher than the surrounding surface of the member of the lower surface of the path 45, that is, protrudes upward from the lower surface of the feed path 42.

Figure 7:
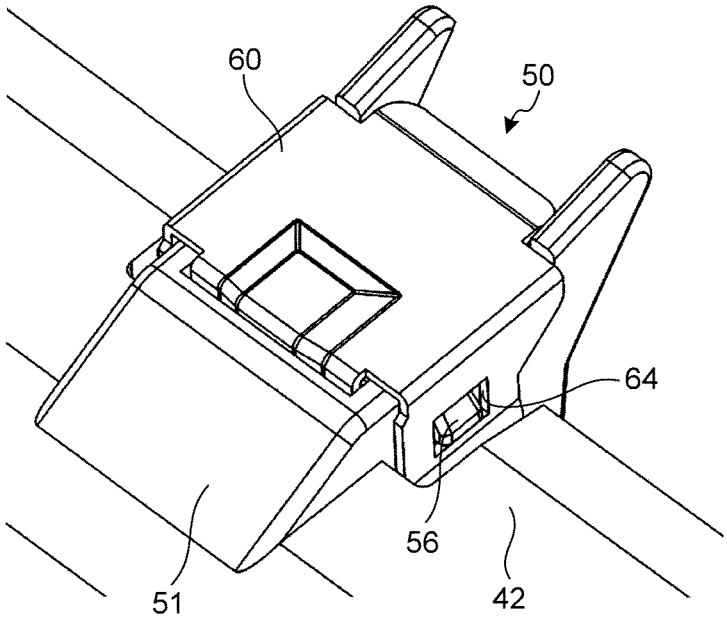
FIG. 7 is a detailed view of the section D illustrated in FIG. 6.

FIG. 7 is a detailed view of the section D illustrated in FIG. 6. A sheet-metal member 60 that is a metal member is mounted on the surface of the protruding portion 50. Specifically, the protruding portion 50 is constituted of a guiding protrusion 51 and the sheet-metal member 60 mounted on the guiding protrusion 51 provided on the member of the lower surface of the path 45 and formed so as to protrude from the lower surface of the feed path 42.

Figure 8:
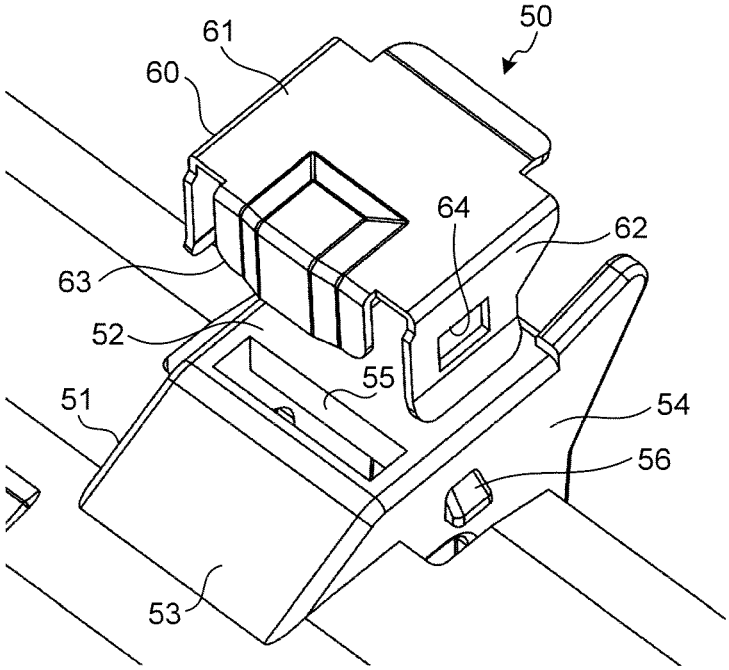
FIG. 8 is a perspective view of a state in which a sheet-metal member illustrated in FIG. 7 is removed from a guiding protrusion.
Figure 9:
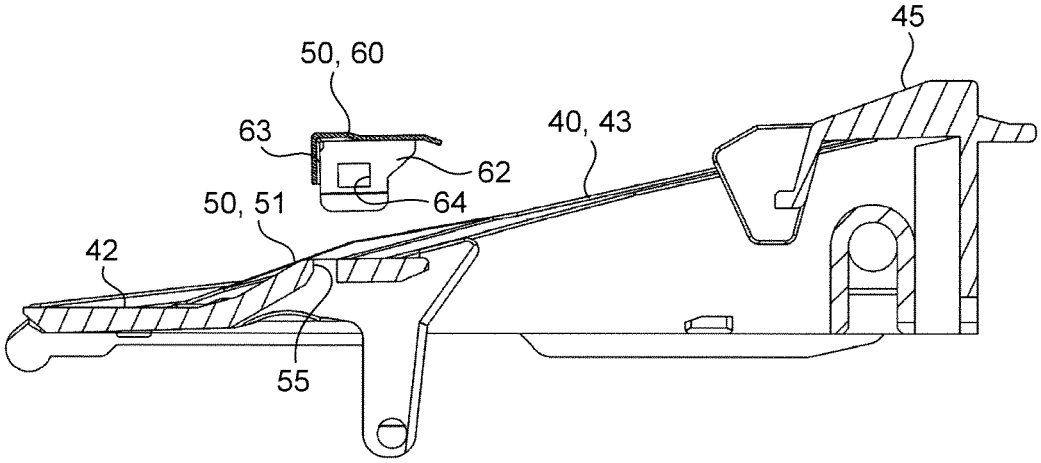
FIG. 9 a cross-sectional view of a member of the lower surface of the path in a state in which the sheet-metal member is removed from the guiding protrusion.

FIG. 8 is a perspective view of a state in which the sheet-metal member illustrated in FIG. 7 is removed from the guiding protrusion. FIG. 9 is a cross-sectional view of the member of the lower surface of the path in a state in which the sheet-metal member is removed from the guiding protrusion. The guiding protrusion 51 includes a plane portion 52 located on the upper end of the guiding protrusion 51, a sloped portion 53, and side walls 54. The sloped portion 53 is located on the downstream side of the plane portion 52 in the conveying direction in the feed path 40 and connects the plane portion 52 and the lower surface of the feed path 42. The side walls 54 are located on both sides in the lateral direction of the plane portion 52 and face both sides of the plane portion 52. On the plane portion 52, an insertion portion 55 that is a hole opened in the thickness direction of the plane portion 52 and extending in the lateral direction in the vicinity of the sloped portion 53. An engagement portion 56 that protrudes in the lateral direction is formed on each of the right and left side walls 54.

The sheet-metal member 60 is formed so as to cover the plane portion 52 and the side wall 54 of the guiding protrusion 51. The sheet-metal member 60 includes an upper surface 61 placed over the plane portion 52, and side surfaces 62 located on both sides in the lateral direction of the upper surface 61 and placed over the side walls 54 of the guiding protrusion 51. On an end portion on the downstream side of the upper surface 61 in the conveying direction in the feed path 40, a tab portion 63 is formed that protrudes downward, that is, toward the plane portion 52 of the guiding protrusion 51. Each of the right and left side surfaces 62 has an engagement hole 64 penetrating through the side surface 62.

The sheet-metal member 60 is detachably mounted on the guiding protrusion 51. Specifically, the tab portion 63 of the sheet-metal member 60 is inserted into the insertion portion 55 of the guiding protrusion 51 and the engagement portion 56 of the guiding protrusion 51 is inserted into the engagement hole 64 to engage the engagement hole 64 with the engagement portion 56.

Figure 10:
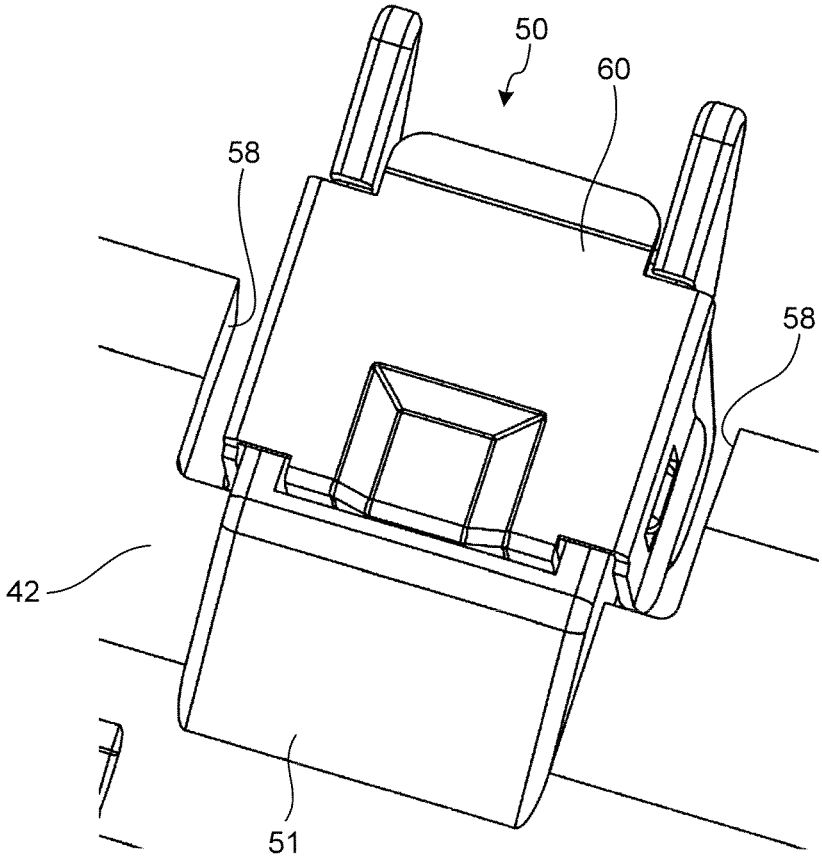
FIG. 10 is a perspective view of the protruding portion illustrated in FIG. 7 viewed from another angle.

FIG. 10 is a perspective view of the protruding portion illustrated in FIG. 7 viewed from another angle. Slits 58 are formed on the sides of the protruding portion 50 so that the protruding portion 50 is separated from the lower surface of the feed path 42 located on both sides of the protruding portion 50. Specifically, the guiding protrusion 51 of the protruding portion 50 is formed so that the sloped portion 53 protrudes upward from the lower surface of the feed path 42. The plane portion 52 and one of the side walls 54 are connected at the end portion on the upstream side of the sloped portion 53 in the conveying direction in the feed path 40. The side walls 54 are separated from the parts facing themselves with narrow spaces interposed therebetween, thereby forming the slits 58. The slits 58 are therefore formed on the sides of the protruding portion 50, along the conveying direction in the feed path 40.

The side surfaces 62 of the sheet-metal member 60 come into the slit 58 and cover the side walls 54. Accordingly, when the sheet-metal member 60 is mounted on the guiding protrusion 51, the side surfaces 62 of the sheet-metal member 60 are separated from the side walls 54 and separated from the portions forming the slits 58, together with the side walls 54. That is to say, even when the sheet-metal member 60 is mounted on the guiding protrusion 51, the slits 58 are formed on the sides of the protruding portion 50.

The protruding portion 50 has the structure, as described above, that only the end portion on the downstream side of the plane portion 52 and the side wall 54 in the conveying direction in the feed path 40 is connected to the sloped portion 53, and the slits 58 are formed on the sides of the protruding portion 50. The protruding portion 50 therefore can bend in the rotational moving direction around the connected part with the sloped portion 53. Specifically, the protruding portion 50 bends in the rotational moving direction around the end portion on the downstream side of the plane portion 52 and the side wall 54 in the conveying direction in the feed path 40, accompanied with the elasticity of the material included in the member of the lower surface of the path 45. The protruding portion 50 therefore is capable of bending in its protruding direction.

Figure 11:
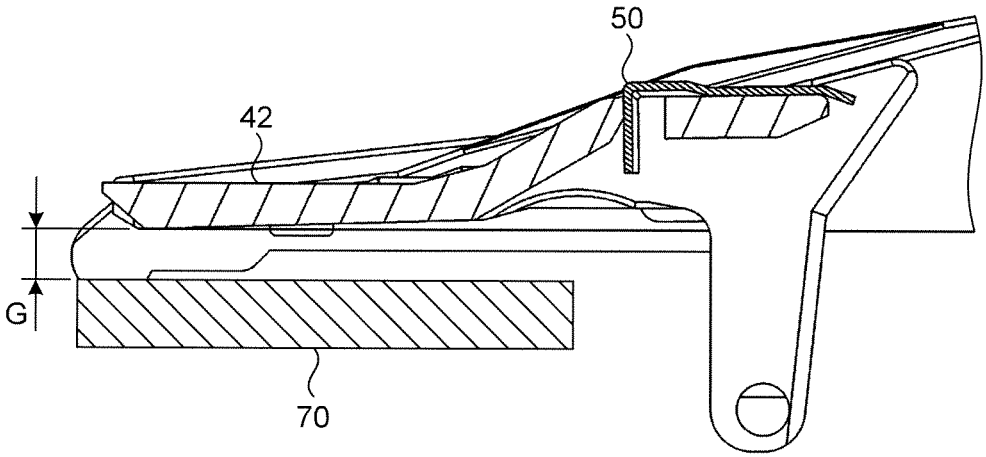
FIG. 11 is a detailed view of the section F illustrated in FIG. 5.
Figure 12:
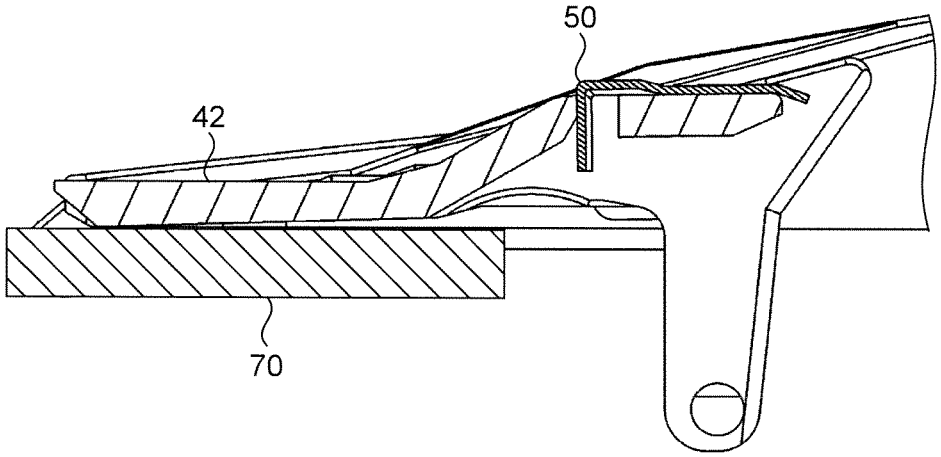
FIG. 12 is an explanatory view of the protruding portion illustrated in FIG. 11 in a bended state.

FIG. 11 is a detailed view of the section F illustrated in FIG. 5. FIG. 12 is an explanatory view of the protruding portion illustrated in FIG. 11 in a bended state. The member of the lower surface of the path 45 is provided so that the portion located on the downstream side of the protruding portion 50 in the conveying direction in the feed path 40 is provided on a frame 70 located below the member of the lower surface of the path 45, with a gap G interposed therebetween (FIG. 11). This enables the member of the lower surface of the path 45 to bend in a direction in which the gap G reduces, accompanied with the elasticity of the material included in the member of the lower surface of the path 45 (FIG. 12). Specifically, the member of the lower surface of the path 45 can bend around a part in the vicinity of the upstream side of the protruding portion 50 in the conveying direction in the feed path 40, in a direction in which the gap G reduces. The protruding portion 50 therefore is capable of bending in its protruding direction.

The feeder 1 according to the embodiment of the present invention is structured as described above. The operations of the feeder 1 will now be described. When the image-reading apparatus 5 including the feeder 1 reads images on the sheet S, the image-reading apparatus 5 starts reading the images in a state in which the sheet S to be read is placed on the tray 15. When the image-reading apparatus 5 starts reading the images, the driving unit 30 drives. The driving force generated in the driving unit 30 is then transmitted to the pick-up roller 21, which rotates the pick-up roller 21. The pick-up roller 21 is provided in such a position so as to come in contact with the sheet S from the lower side of the sheet S placed on the tray 15, whereby the sheet S is fed out in the conveying direction Y1 due to the friction force between the sheet S and the rotating pick-up roller 21.

When the sheet S is conveyed, the driving force generated in the driving unit 30 also rotates the brake roller 23. The brake roller 23 comes in contact with the sheet S from the upper side of the sheet S. The brake roller 23 rotates in the direction in which the contact portion with the sheet S is reverse to the conveying direction Y1 of the sheet S, whereby the sheet(s) S stacked on the sheet S contacting the pick-up roller 21 is pressed back toward the tray 15. This enables the separation mechanism 20 to separate the sheet S one by one from a plurality of sheets S stacked on the placement surface 16 of the tray 15 and feed out the sheet S in the conveying direction Y1. The sheet S is then conveyed through the lead-in portion 43 of the feed path 40.

The sheet S conveyed through the lead-in portion 43 is then conveyed by the conveying roller 26 in the conveying direction Y1, to the reading unit 44 of the feed path 40. The image reading unit 35 is provided in the reading unit 44 of the feed path 40 thus the image reading unit 35 reads the images on the sheet S conveyed through the reading unit 44. After the image reading unit 35 reads the images on the sheet S, the sheet S is conveyed in the conveying direction Y1 by the ejecting roller 27 provided on the downstream side in the conveying direction Y1 of the image reading unit 35.

The sheet S of which images have been read is ejected through the ejecting port 11. The sheet S located at the lowest position out of the sheets S stacked on the tray 15 is subsequently conveyed and the images thereon are read. The feeder 1 and the image-reading apparatus 5 including the feeder 1 repeat these operations to sequentially convey the sheets S stacked on the tray 15 one by one, thereby sequentially read images on the sheets S stacked on the tray 15.

When the feeder 1 conveys the sheet S, as described above, the sheet S placed on the tray 15 is led into the feed path 40 by the pick-up roller 21 and conveyed therethrough toward the conveying roller 26. The protruding portion 50 is formed between the pick-up roller 21 and the conveying roller 26 in the feed path 40. The protruding portion 50 protrudes with the height slightly smaller than the height of the designed path for the sheet S. Accordingly, the protruding portion 50 contacts or does not contact the sheet S depending on the thickness of the sheet S when the sheet S is conveyed in a normal manner.

By contrast, vibration is sometimes generated when the sheet S is conveyed, due to a stick-and-slip phenomenon generated between the brake roller 23 and the sheet S or by the material properties of the sheet S, for example. In this case, the sheet S is conveyed while vibrating in the vertical direction, that is, in the direction of the upper surface of the feed path 41 and the lower surface of the feed path 42. The sheet S is therefore conveyed with a width in the vertical direction larger than the designed path for the sheet S. The vibrating sheet S thus comes in contact with the protruding portion 50. After the sheet S comes in contact with the protruding portion 50, the vibration of sheet S is reduced. In the state in which the vibration of sheet S is reduced, the sheet S is conveyed through the lead-in portion 43 in the feed path 40 toward the conveying roller 26.

In the image-reading apparatus 5, a rigid sheet such as a card made of a synthetic resin material and a cardboard is sometimes used as a document having images to be read. When such a document like a card described above is used, the document is stacked on the tray and lead by the pick-up roller 21 into the feed path 40 and conveyed through the feed path 40, in the same manner when the sheet S made of a thin paper is used. In this case, the card or the cardboard is thicker than a thin paper, whereby the width in the vertical direction of the sheet S increases during the conveyance of the sheet S.

The card or the cardboard comes in contact with the protruding portion 50 with a large contact area during its conveyance. The member of the lower surface of the path 45 is provided on the frame 70 with the gap G interposed therebetween to enable the member of the lower surface of the path 45 to bend. The protruding portion 50 is therefore capable of bending in its protruding direction. Accordingly, when the card or the cardboard is conveyed and it comes in contact with the protruding portion 50, the card or the cardboard can be conveyed without being obstructed by the protruding portion 50 because the protruding portion 50 bends downward.

In addition, the slits 58 are formed on the sides of the protruding portion 50, which also enables the protruding portion 50 to bend. When the card or the cardboard is conveyed and comes in contact with the protruding portion 50, the protruding portion 50 thus readily bends downward, whereby the card or the cardboard can be conveyed without being obstructed by the protruding portion 50.

The protruding portion 50 formed in the feed path 40 comes in contact with the sheet S depending on the types of the sheet S, and comes in contact with the sheet S with a large contact area when a card or a cardboard, in particular, is conveyed. In these examples, the sheet S comes in contact with the sheet-metal member 60 rather than the protruding portion 50, thus the protruding portion 50 can be hardly worn down.

In the document feeder 1 according to the embodiment, the protruding portion 50 protruding from the lower surface of the feed path 42, is provided between the pick-up roller 21 and the conveying roller 26 in the feed path 40, as described above. Therefore, if vibration is generated when a document such as the sheet S is conveyed, the protruding portion 50 comes in contact with the document, thereby reducing the vibration of the document. The protruding portion 50 simply protrudes from the lower surface of the feed path 42, thus the document can be conveyed without being obstructed during the conveyance of the document. This can reduce the vibration of the document without obstructing the conveyance of the document.

The protruding portion 50 is formed so as to be capable of bending in the protruding direction. When a card or a cardboard is used as a document and the card or the cardboard comes in contact with the protruding portion 50, the protruding portion 50 is capable of bending, thereby reducing the obstruction of the conveyance of the card or the cardboard. This can more surely reduce the vibration of the document without obstructing the conveyance of the document.

The slits 58 are formed on the sides of the protruding portion 50, which enables the protruding portion 50 to bend in the protruding direction. This can help the protruding portion 50 to bend more surely in the protruding direction. When a card or the like comes in contact with the protruding portion 50, the protruding portion 50 can bend more surely. This can reduce the obstruction of the conveyance of the document more surely.

The sheet-metal member 60 is mounted on the surface of the protruding portion 50, whereby the wear of the protruding portion 50 resulting from the friction between the document and itself can be reduced. This makes it possible to enjoy the advantageous effects in that the vibration of the document can be reduced in a stable manner.

In addition, the sheet-metal member 60 is detachably mounted on the guiding protrusion 51, thus can be readily replaced with a new one when it is worn down. This makes it possible to enjoy the advantageous effects in that the vibration of the document can be reduced in a stable manner more surely.

Modification

In the feeder 1 according to the embodiment, the protruding portion 50 is structured so that the sheet-metal member 60 is mounted on the guiding protrusion 51. The present invention, however, is not limited to this example. The protruding portion 50 may not include the sheet-metal member 60. The protruding portion 50 can include only the guiding protrusion 51 without the sheet-metal member 60, whereby the manufacturing cost of the feeder 1 can be reduced.

In the feeder 1 according to the embodiment, the protruding portion 50 capable of bending is achieved with the structure in which the gap G is formed between the member of the lower surface of the path 45 and the frame 70, or the slits 58 are formed. The protruding portion 50 capable of bending, however, can be achieved with other structures. Any structure can be used as long as it can enable the protruding portion 50 to bend in a direction in which the conveyance of the document is not obstructed when a thick document comes in contact with the protruding portion 50.

The feeder 1 according to the embodiment can be structured by combining the structures of the embodiment and the modification described above or by adopting another structure. Regardless of the structure of the feeder 1, by providing the protruding portion 50 that protrudes from the lower side of the feed path 40, between the pick-up roller 21 and the conveying roller 26 in the feed path 40, the vibration of the document can be reduced without obstructing the conveyance of the document.

A document feeder according to an aspect of the present invention can provide the advantageous effect of reducing the vibration of a document during the conveyance of the document without obstructing the conveyance of the document.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A document feeder comprising:

a first feed roller and a second feed roller provided side by side in a feed path for a document, the first and second feed rollers being separated from each other and arranged in a lateral direction relative to the feed path;

a brake roller provided at a position across the first and second feed rollers in the feed path, the brake roller separating the document one by one in cooperation with the first and second feed rollers;

a conveying roller provided on a downstream side of the first feed roller and the second feed roller in the feed path, the conveying roller and the first and second feed rollers being arranged in a feed path direction; and a protruding portion provided at a position between the conveying roller and the first and the second feed rollers and between the first feed roller and the second feed roller, the protruding portion being formed on a member on a lower side of the feed path and protruding from the lower side toward an upper side of the feed path, wherein the protruding portion protrudes with a height slightly smaller than a height of a predetermined feed path for the document so that the protruding portion contacts or does not contact the document depending on a thickness of the document when the document is conveyed in a normal manner, and the protruding portion comes into contact with the document so as to reduce a vibration of the document separated by the brake roller when the vibration is generated.

2. The document feeder according to claim 1, wherein the protruding portion is formed so as to be capable of bending in a protruding direction.

3. The document feeder according to claim 2, wherein the protruding portion has a slit on a side thereof, the slit enabling the protruding portion to bend in the protruding direction.

4. The document feeder according to claim 1, wherein the protruding portion is provided with a metal member mounted on a surface thereof.

5. A document feeder comprising:

a tray for accommodating a document in a stacked manner;

a feed roller provided on a lower side of the tray, the feed roller feeding the document stacked on the tray in a feed path;

a brake roller provided at a position across the feed roller on an upper side of the tray, the brake roller separating the document one by one in cooperation with the feed roller;

a conveying roller provided on a downstream side of the feed roller in the feed path, the conveying roller conveying the document separated by the brake roller; and a protruding portion provided at a position between the conveying roller and the feed roller and formed on a member on a lower side of the feed path, the protruding portion protruding from the lower side toward an upper side of the feed path with a height slightly smaller than a height of a predetermined feed path for the document such that the protruding portion contacts or does not contact the document depending on a thickness of the document when the document is conveyed in a normal manner, wherein the protruding portion comes in contact with the document so as to reduce a vibration of the document separated by the brake roller when the vibration is generated.

* * * * *